United States Patent [19]

Kawakami et al.

[11] Patent Number: 4,985,396

[45] Date of Patent: Jan. 15, 1991

[54] DYE TRANSFER TYPE THERMAL PRINTING SHEETS

[75] Inventors: Tetsuji Kawakami, Katano; Akihiro Imai; Nobuyoshi Taguchi, both of Ikoma; Yukichi Murata, Sagamihara; Takao Hirota, Machida, all of Japan

[73] Assignees: Matsushita Electric Industrial Co., Ltd; Mitsubishi Kasei Corporation, Osaka, both of Japan

[21] Appl. No.: 288,139

[22] Filed: Dec. 22, 1988

[30] Foreign Application Priority Data

Dec. 29, 1987 [JP] Japan ..... 62-334576

[51] Int. Cl.[5] ..... B41M 5/035; B41M 5/26

[52] U.S. Cl. ..... 503/227; 8/471; 428/195; 428/913; 428/914

[58] Field of Search ..... 8/471; 428/195, 913, 428/914; 503/227

[56] References Cited

U.S. PATENT DOCUMENTS 4,614,521 9/1986 Niwa et al. ..... 8/471
4,771,035 9/1988 Murata et al. ..... 503/227
4,820,685 4/1989 Murata ..... 503/227
4,829,047 5/1989 Niwa et al. ..... 503/227

FOREIGN PATENT DOCUMENTS 3524519 1/1986 Fed. Rep. of Germany ..... 503/227
2159971 12/1985 United Kingdom ..... 503/227
87/06533 11/1987 World Int. Prop. O. ..... 503/227

*Primary Examiner*—Bruce H. Hess
*Attorney, Agent, or Firm*—Stevens, Davis, Miller & Mosher

[57] ABSTRACT

The present invention provides a dye transfer type thermal printing sheet which can give a color record image excellent in color reproducibility and weather resistance with middle shade including black and sufficiently saturated density. This printing sheet comprising a substrate on which are arranged, in face-sequence, coloring material layers which are different in hue and contain either of at least one dye represented by the formula (I), at least one dye represented by the formual (II) and at least one dye represented by the formulas (III)-(VI).

2 Claims, 2 Drawing Sheets

DYE TRANSFER TYPE THERMAL PRINTING SHEETS

BACKGROUND OF THE INVENTION

1. Field of the Invention

The present invention relates to a dye transfer type thermal printing sheet which can be used for high-speed recording by electronic devices such as thermal head, electrode head and laser head.

2. Description of the Prior Art

According to dye transfer type thermal printing method, a part of a sublimable dye in a coloring material layer provided on a support is transferred to an image receiving material to record an image. The coloring material layer normally comprises a sublimable dye and a binder for binding the dye onto a support. Hitherto, as the dyes used for recording of this type there have been used ionic dyes containing color former high in sublimability and transfer textile printing dyes excellent in stability used for polyester textile.

However, transfer type thermal printing sheets containing these dyes suffer from the following problems.

(1) When ionic dyes are used, sufficient color density can be obtained, but storage stability of sheets is not satisfactory.

(2) Sheets in which transfer printing textile dyes for textile printing are used are inferior in coloring power because sublimability or diffusion transferability of the dyes is low and hence, it is difficult to obtain sufficient color density by thermal energy provided by ordinary thermal head.

(3) Matching in color density characteristics of three colors of cyan, magenta and yellow is inferior and not only black sufficient in middle shade and saturation density cannot be obtained, but also color reproducibility of other colors is insufficient as compared with reproducibility obtained by color printing.

In order to solve these problems, improvements as proposed in unexamined-published Japanese Patent Kokai No. 60-229794 have been made, but these are still not sufficient in weather resistance of recorded image and storage stability of transfer sheet.

SUMMARY OF THE INVENTION

The object of the present invention is to provide a dye transfer type thermal printing sheet (sometimes referred to as merely "transfer sheet" hereinafter) which can afford middle shade and sufficient saturation density of each color including black and besides can give color record image superior in color reproducibility and weather resistance using sublimable dyes of cyan, magenta and yellow which are stable and excellent in transferability (sublimability and thermal diffusibility).

The dye transfer type thermal printing sheet of the present invention comprises coloring material layers provided in sequence on a substrate which are different in hue and each of which contains a binder and at least one sublimable cyan dye represented by the following formula (I), a binder and at least one sublimable magenta dye represented by the following formula (II) and a binder and at least one sublimable yellow dye represented by the following formulas (III)-(VI) among those represented by the formulas (I)-(VI):

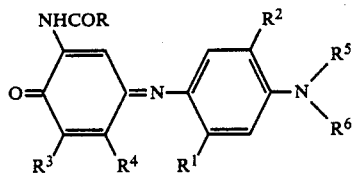

(I)

(wherein $R^1$ represents a hydrogen atom, an alkyl group which may be substituted with fluorine atom, an alkoxy group, a formylamino group, an alkylcarbonylamino group which may be substituted with fluorine atom, an arylcarbonylamino group or a halogen atom, $R^2$ represents a hydrogen atom, an alkyl group which may be substituted with fluorine atom, an alkoxy group or a halogen atom, $R^3$ and $R^4$ each represents a hydrogen atom, an alkyl group which may be substituted with fluorine atom, an alkoxy group or a halogen atom and R, $R^5$ and $R^6$ each represents a hydrogen atom, a substituted or unsubstituted alkyl group of 1-8 carbon atoms or an aryl group).

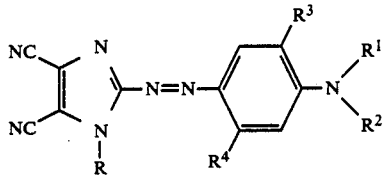

(II)

(wherein R, $R^1$ and $R^2$ each represents an allyl group, an alkyl group of 1-8 carbon atoms, an alkoxyalkyl group of 3-8 carbon atoms, an aralkyl group or a hydroxyalkyl group, $R^3$ represents a hydrogen atom, an alkoxy group of 1-4 carbon atoms, a methyl group or a halogen atom and $R^4$ represents a methyl group, a methoxy group, a formylamino group, an alkylcarbonylamino group of 1-8 carbon atoms, an alkylsulfonylamino group of 1-8 carbon atoms or an alkoxycarbonylamino group of 1-8 carbon atoms).

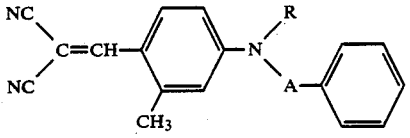

(III)

(wherein R represents an allyl group, a methyl group, an ethyl group or a straight chain or branched chain propyl group or a straight chain or branched chain butyl group and A represents $-CH_2-$, $-CH_2CH_2-$, $CH_2CH_2O-$, $CH_2CH_2OCH2-$ or $-CH_2CH_2OCH_2CH_2-$).

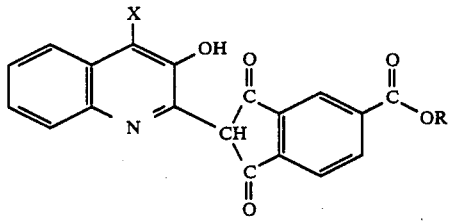

(IV)

(wherein X represents a hydrogen atom or a halogen atom and R represents an alkyl group, an aralkyloxyalkyl group which may be substituted, an allyloxyalkyl group which may be substituted, an aryloxyalkyl group which may be substituted, a tetrahydrofurfuryl group, a furfuryl group, a cycloalkyl group, an allyl group, an aralkyl group or an alkoxyalkyl group).

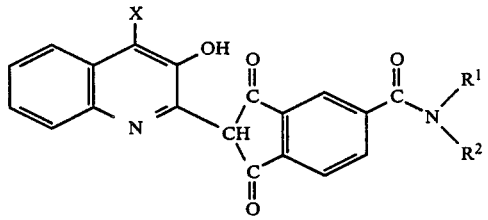

(V)

(wherein X represents a hydrogen atom or a halogen atom and $R^1$ and $R^2$ each represents a hydrogen atom, an alkyl group, an alkoxyalkyl group, a cycloalkyl group, an allyl group, an aryl group which may have substituent, an aralkyl group, a furfuryl group, a tetrahydrofurfuryl group or a hydroxyalkyl group).

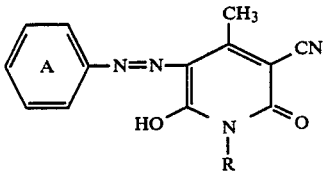

(VI)

(wherein

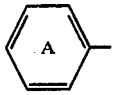

represents a phenyl group which may be substituted with an alkyl group of 1-13 carbon atoms, an alkoxy group of 1–12 carbon atoms, a halogen atom, a nitro group, a cyano group, an alkoxycarbonyl group of 2–13 carbon atoms or a benzyloxycarbonyl group and R represents a straight chain or branched chain alkyl group of 1–12 carbon atoms, a lower alkoxyalkyl group, an allyl group or a hydrogen atom).

DETAILED DESCRIPTION OF THE INVENTION

According to the present invention, a dye transfer type thermal printing sheet is constructed by arranging coloring material layers in face-sequence which are different in hue and containing subliming dyes represented by the formulas (I)–(VI) which are stable and excellent in sublimability.

Figure 1:
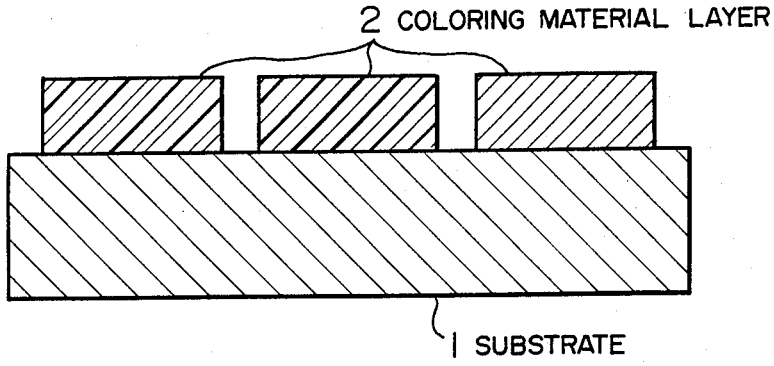
FIG. 1 is a cross-sectional schematic view of a dye transfer type thermal printing sheet in example of the present invention.

As shown in FIG. 1, substrate 1 supports coloring material layers 2 containing dyes to be transferred and is not critical. For example, the substrate may be film such as PET, cellophane, polyaramide, polyarylate, polycarbonate and polyimide. Furthermore, the substrate may be these films to which heat resistance, lubricity, electric conductivity or light absorbency is imparted. Coloring material layers 2 contain at least a binder and at least one dye represented by the formula (I), at least one dye represented by the formula (II) and at least one dye represented by the formulas (III)–(VI) among the subliming dyes represented by the formulas (I)–(VI). Sequence of arranging of coloring material layers of three or four faces of cyan, magenta and yellow and, if necessary, black is not critical.

The substituent $R^1$ in the formula (I) includes a hydrogen atom, an alkyl group (preferably, having 1–4 carbon atoms) which may be substituted with fluorine atom, an alkoxy group (preferably, having 1–4 carbon atoms), a formylamino group, an alkylcarbonylamino group (preferably, having 2–5 carbon atoms) which may be substituted with fluorine atom, an arylcarbonylamino group and a halogen atom such as fluorine atom, chlorine atom or bromine atom. $R^1$ is preferably hydrogen atom, methyl group, ethyl group or methylcarbonylamino group. The substituent $R^2$ includes a hydrogen atom, an alkyl group (preferably, having 1–4 carbon atoms) which may be substituted with fluorine atom, an alkoxy group (preferably, having 1–4 carbon atoms) or a halogen atom. Among them, especially preferred are hydrogen atom, methyl group, methoxy group, trifluoromethyl group and halogen atom. The substituents $R^3$ and $R^4$ include a hydrogen atom, an alkyl group (preferably, having 1–4 carbon atoms) which may be substituted with fluorine atom, an alkoxy group and a halogen atom. As $R^3$, hydrogen atom and halogen atom are preferred. As $R^4$, hydrogen atom, alkyl group having 1–4 carbon atoms such as methyl and ethyl, alkoxy group having 1–4 carbon atoms and halogen atom are preferred. The substituents R, $R^5$ and $R^6$ include hydrogen atom, substituted or unsubstituted alkyl group having 1–8 carbon atoms and aryl group. As $R^5$ and $R^6$, preferred are hydrogen atom, alkyl groups having 1–8 carbon atoms, alkoxyalkyl groups having 3–8 carbon atoms, alkoxyalkyl groups having 5–8 carbon atoms, benzyl group, β-phenylethyl group, β-cyanoethyl group, β-chloroethyl group, β-hydroxyethyl group, β-phenoxyethyl group, allyl group, phenyl group, acyloxyalkyl groups having 8 or less carbon atoms, alkoxycarbonylalkyl groups having 8 or less carbon atoms, alkoxycarbonyloxyalkyl groups having 8 or less carbon atoms and tetrahydrofurfuryl group. As R, preferred are alkyl groups having 1–4 carbon atoms, alkoxyalkyl groups having 3–8 carbon atoms, allyl group, phenyl group, tetrahydrofurfuryl group, fluorine-substituted alkyl groups having 1–4 carbon atoms, β-hydroxyethyl group and β-cyanoethyl group.

Since hue of record image and recording sensitivity may somewhat vary depending on kind of substituents, a coloring material layer of one color may comprise a mixture of two or more dyes different in substituents for adjustment of hue and sensitivity.

Substituents R, $R^1$ and $R^2$ in the formula (II) include allyl group, alkyl groups having 1–8 carbon atoms, alkoxyalkyl groups having 3–8 carbon atoms, aralkyl groups (preferably benzyl group and β-phenylethyl group) and hydroxyalkyl groups (preferably hydroxyethyl group). Substituent $R^3$ includes hydrogen atom, alkoxy groups having 1–4 carbon atoms, methyl group and halogen atoms, among which hydrogen atom and methoxy group are preferred. Substituent $R^4$ includes methyl group, methoxy group, formylamino group, alkylcarbonylamino groups having 2–8 carbon atoms (preferably, having 2–5 carbon atoms), alkylsulfonylamino groups having 1–8 carbon atoms (preferably, having 1–4 carbon atoms) and alkoxycarbonylamino groups having 2–8 carbon atoms (preferably 2–5 carbon atoms).

Substituent R in the formula (III) includes allyl group, methyl group, ethyl group, straight chain or branched chain propyl group and straight chain or branched chain butyl group. Substituent A includes $-CH_2-$, $-CH_2CH_2-$, $-CH_2CH_2O-$, $-CH_2CH_2OCH_2-$ and $-CH_2CH_2OCH_2CH_2-$.

Substituent X in the formula (IV) includes hydrogen atom and halogen atoms and hydrogen atom is preferred. Substituent R includes alkyl groups (preferably, having 1–12 carbon atoms), aralkyloxyalkyl groups which may be substituted, allyloxyalkyl groups which may be substituted, aryloxyalkyl groups which may be substituted, tetrahydrofurfuryl group, furfuryl group, cycloalkyl groups, allyl group, aralkyl groups and alkoxyalkyl groups (preferably, having 3–8 carbon atoms). Preferred are alkyl groups having 1–12 carbon atoms and alkoxyalkyl groups having 3–8 carbon atoms and more preferred are alkyl groups having 4 or more carbon atoms.

Substituent X in the formula (V) includes hydrogen atom and halogen atoms. Hydrogen atom and bromine atom are preferred. Substituents $R^1$ and $R^2$ include hydrogen atom, alkyl groups (preferably, having 1–12 carbon atoms), alkoxyalkyl groups (preferably, 3–8 carbon atoms), cycloalkyl groups, allyl group, aryl groups which may be substituted, aralkyl groups, furfuryl group, tetrahydrofurfuryl group and hydroxyalkyl groups. Preferred are alkyl groups having 1–12 carbon atoms and alkoxyalkyl groups having 3–8 carbon atoms.

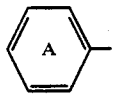

in the formula (VI) includes phenyl groups which may be substituted with alkyl group of 1–13, preferably 1–4 carbon atoms, alkoxy group of 1–12, preferably 1–4 carbon atoms, halogen atom, nitro group, cyano group, alkoxycarbonyl group of 2–13 carbon atoms, preferably 2–5 carbon atoms or benzyloxycarbonyl group. Substituent R includes straight chain or branched chain alkyl groups of 1–12 carbon atoms, alkoxyalkyl groups of 2–5 carbon atoms, allyl group and hydrogen atom.

With reference to the dyes represented by the formulas (III)–(VI) which give yellow color, also hue of record image and recording sensitivity may somewhat vary depending on the formulas and substituent. Therefore, a coloring material layer of one color may comprise a mixture of two or more dyes of different formula and different substituent.

Further specific examples of the subliming dyes represented by the formulas (I)–(VI) are shown in the following Tables 1–6. These dyes are generally low in melting point (100°–200° C.) and high in sublimation initiating temperature (a temperature at which weight loss of 5% occurs according to thermobalance method) and are (melt) diffusion transferred through binder or transferred through sublimation or vaporization. Therefore, these dyes are higher in stability than dyes which are transferred only through sublimation.

TABLE 1

| No. | Cyan dyes represented by the formula (I) Structural formula of dye |
|---|---|
| 1-1 | 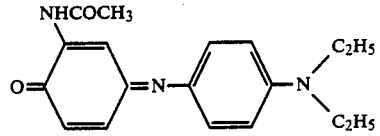 |
| 1-2 | 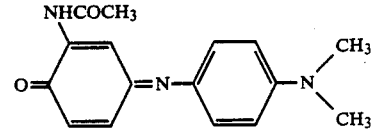 |
| 1-3 | 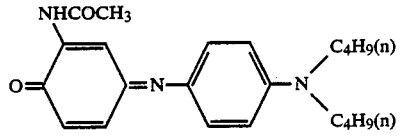 |
| 1-4 | 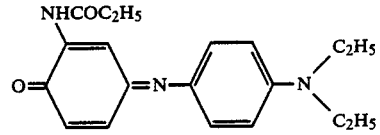 |
| 1-5 | 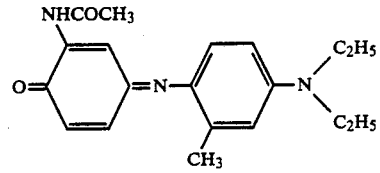 |
| 1-6 | 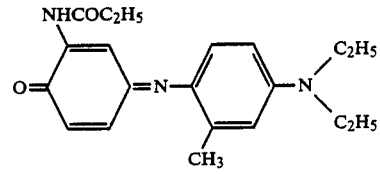 |
| 1-7 | 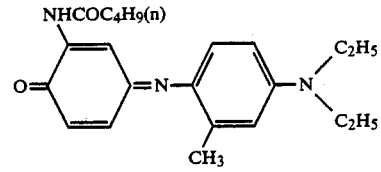 |
| 1-8 | 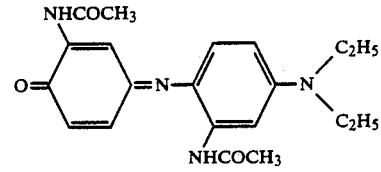 |
| 1-9 | 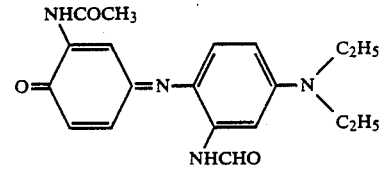 |

TABLE 1-continued
Cyan dyes represented by the formula (I)
| No. | Structural formula of dye |
|---|---|
| 1-10 | 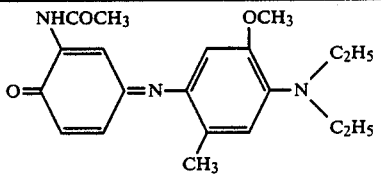 |
| 1-11 | 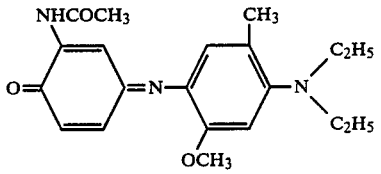 |
| 1-12 | 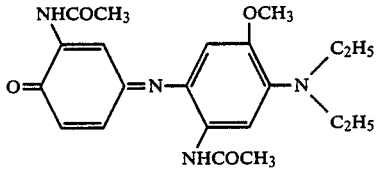 |
| 1-13 | 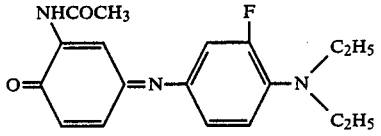 |
| 1-14 | 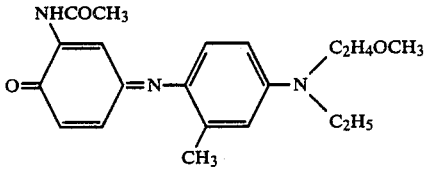 |
| 1-15 | 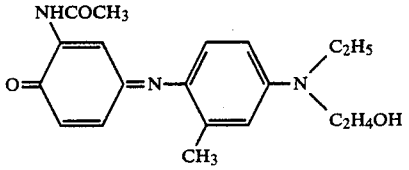 |
| 1-16 | 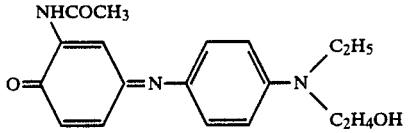 |
| 1-17 | 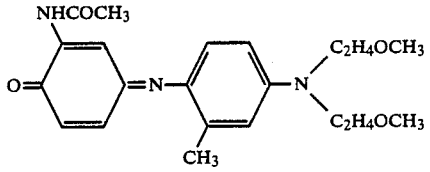 |
| 1-18 | 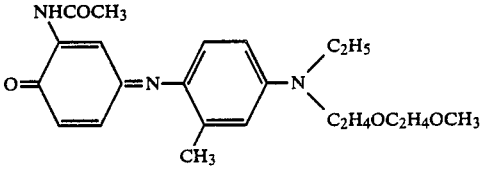 |
TABLE 1-continued
Cyan dyes represented by the formula (I)
| No. | Structural formula of dye |
|---|---|
| 1-19 | 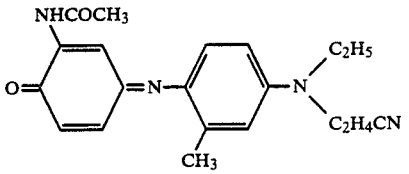 |
| 1-20 | 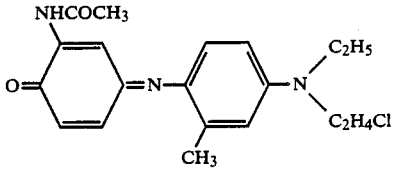 |
| 1-21 | 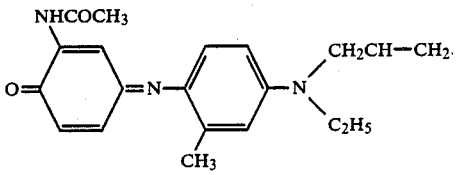 |
| 1-22 | 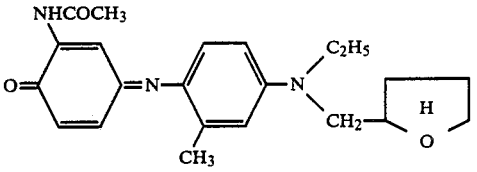 |
| 1-23 | 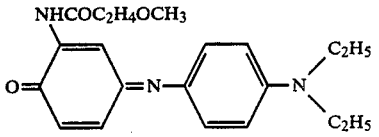 |
| 1-24 | 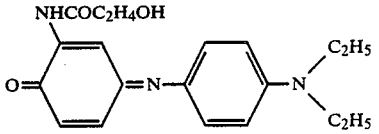 |
| 1-25 | 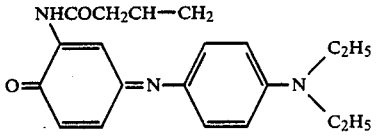 |
| 1-26 | 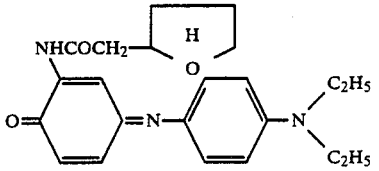 |
| 1-27 | 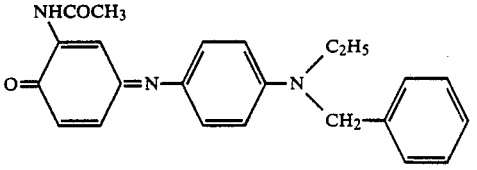 |

TABLE 1-continued
Cyan dyes represented by the formula (I)
| No. | Structural formula of dye |
|---|---|
| 1-28 | 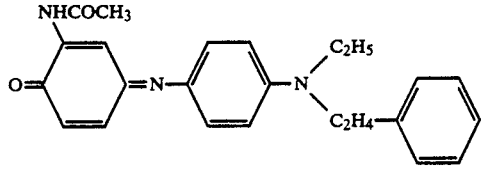 |
| 1-29 | 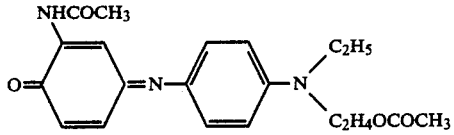 |
| 1-30 | 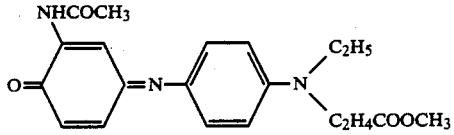 |
| 1-31 | 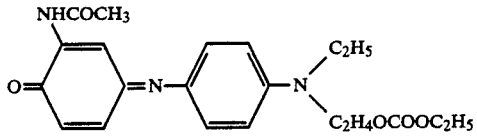 |
| 1-32 | 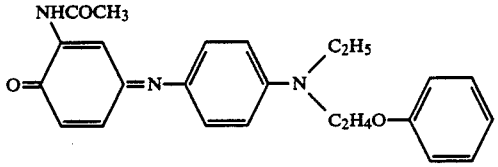 |
| 1-33 | 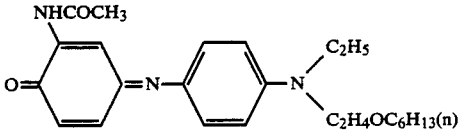 |
| 1-34 | 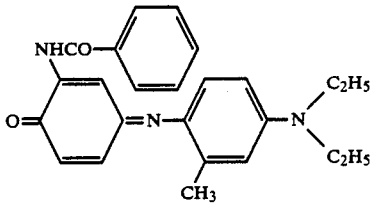 |
| 1-35 | 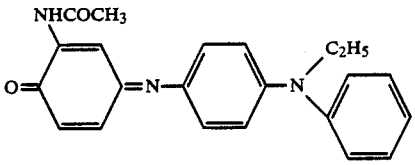 |
| 1-36 | 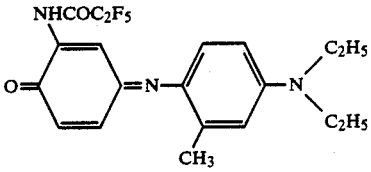 |
TABLE 1-continued
Cyan dyes represented by the formula (I)
| No. | Structural formula of dye |
|---|---|
| 1-37 | 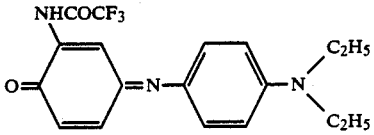 |
| 1-38 | 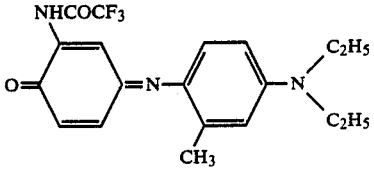 |
| 1-39 | 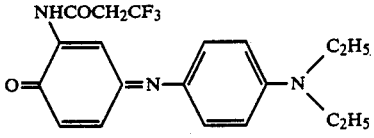 |
| 1-40 | 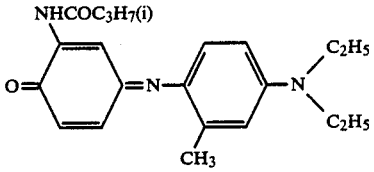 |
| 1-41 | 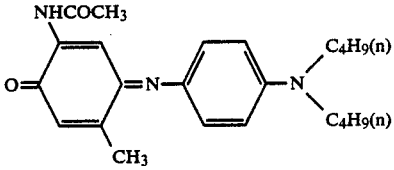 |
| 1-42 | 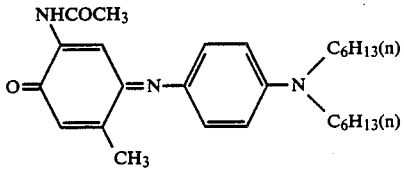 |
| 1-43 | 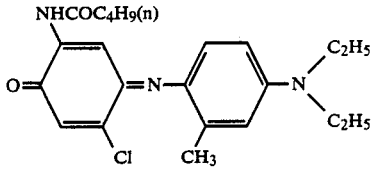 |
| 1-44 | 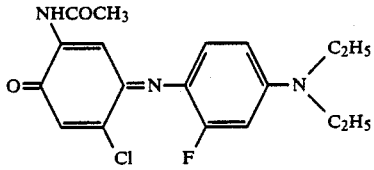 |
| 1-45 | 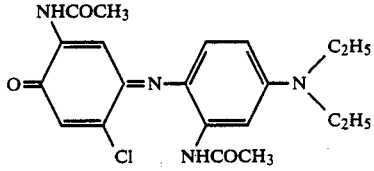 |

TABLE 1-continued
Cyan dyes represented by the formula (I)
| No. | Structural formula of dye |
|---|---|
| 1-46 | 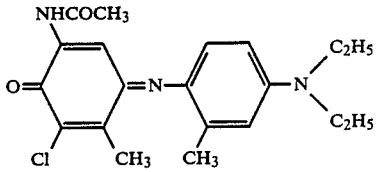 |
| 1-47 | 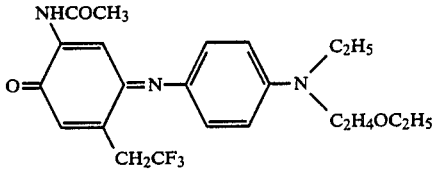 |
| 1-48 | 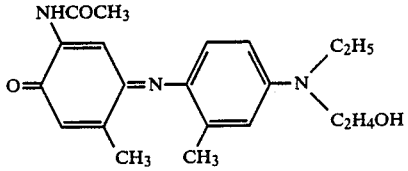 |
| 1-49 | 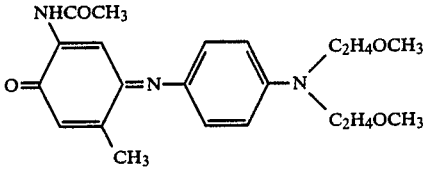 |
| 1-50 | 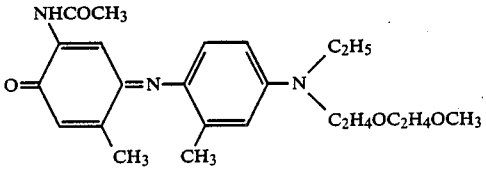 |
| 1-51 | 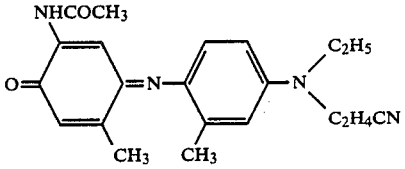 |
| 1-52 | 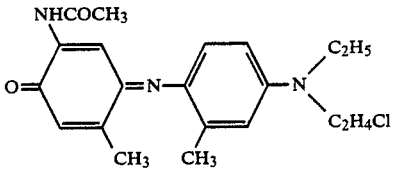 |
| 1-53 | 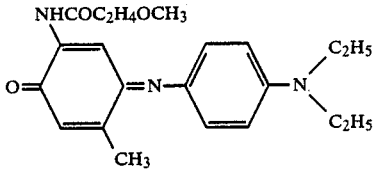 |
TABLE 1-continued
Cyan dyes represented by the formula (I)
| No. | Structural formula of dye |
|---|---|
| 1-54 | 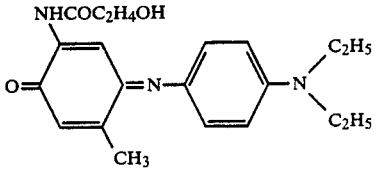 |
| 1-55 | 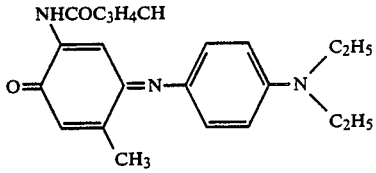 |
| 1-56 | 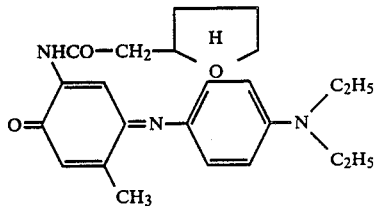 |
| 1-57 | 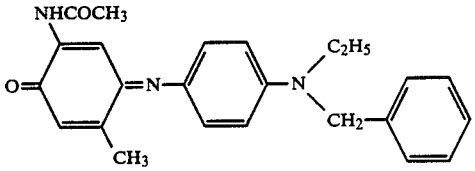 |
| 1-58 | 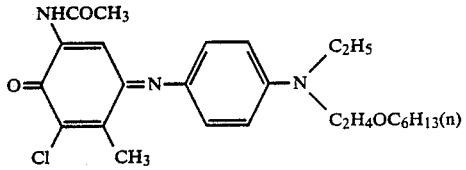 |
| 1-59 | 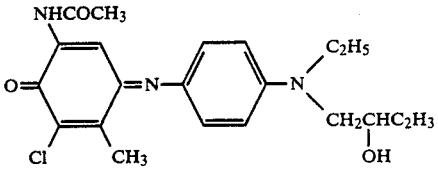 |
| 1-60 | 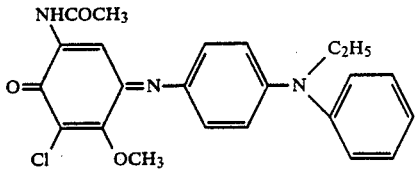 |
| 1-61 | 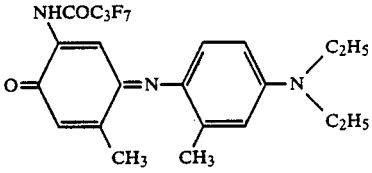 |

TABLE 1-continued
Cyan dyes represented by the formula (I)
| No. | Structural formula of dye |
|---|---|
| 1-62 | 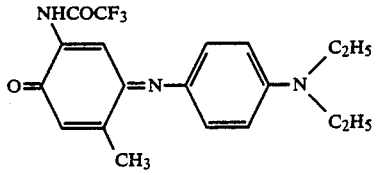 |
| 1-63 | 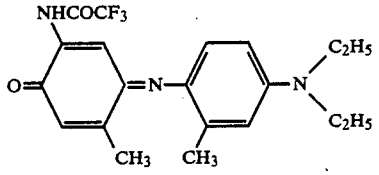 |
| 1-64 | 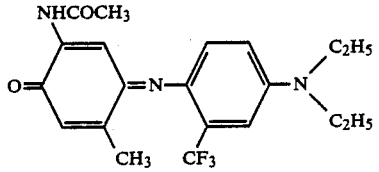 |
| 1-65 | 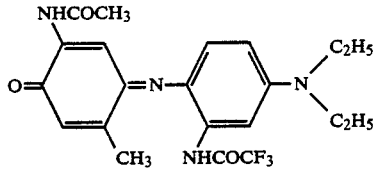 |
| 1-66 | 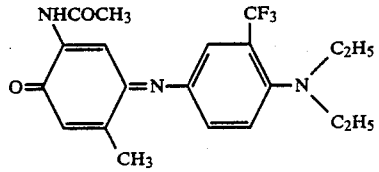 |
| 1-67 | 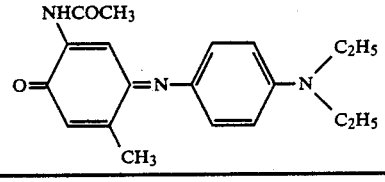 |
TABLE 2
Magenta dyes represented by the formula (II)
| No. | Structural formula of dye |
|---|---|
| 2-1 | 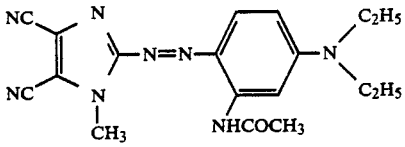 |
| 2-2 | 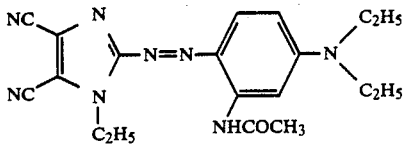 |
TABLE 2-continued
Magenta dyes represented by the formula (II)
| No. | Structural formula of dye |
|---|---|
| 2-3 | 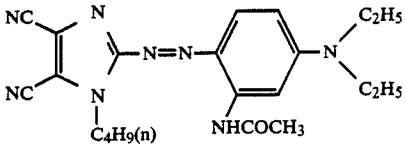 |
| 2-4 | 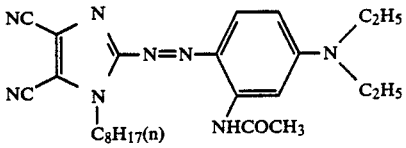 |
| 2-5 | 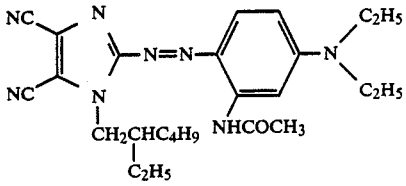 |
| 2-6 | 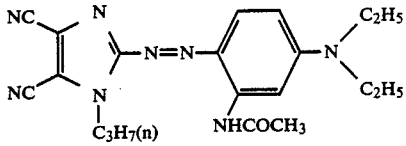 |
| 2-7 | 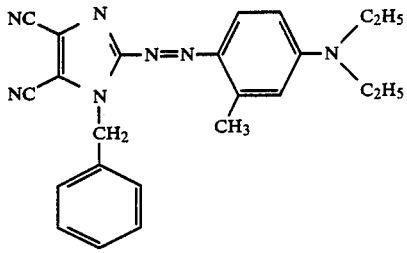 |
| 2-8 | 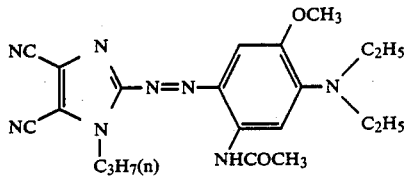 |
| 2-9 | 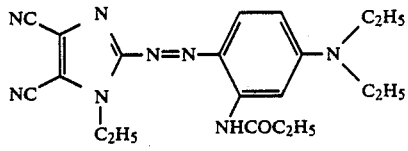 |
| 2-10 | 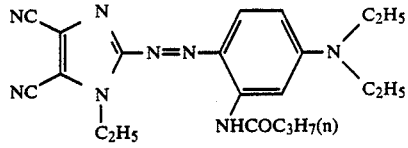 |

TABLE 2-continued
Magenta dyes represented by the formula (II)
| No. | Structural formula of dye |
|---|---|
| 2-11 | 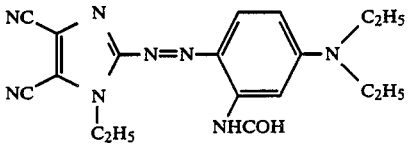 |
| 2-12 | 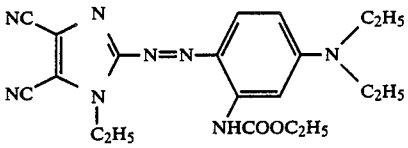 |
| 2-13 | 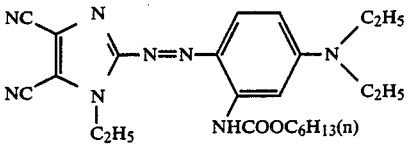 |
| 2-14 | 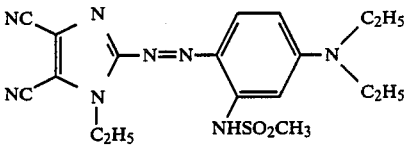 |
| 2-15 | 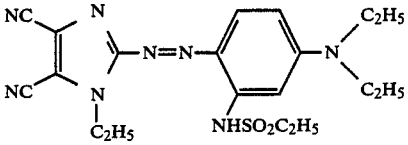 |
| 2-16 | 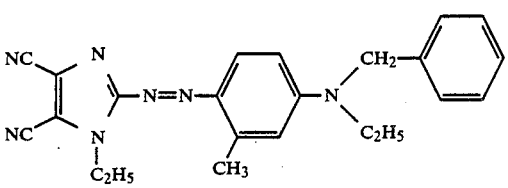 |
| 2-17 | 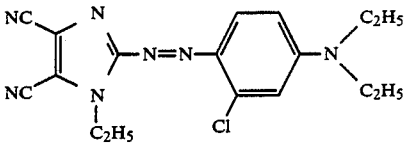 |
| 2-18 | 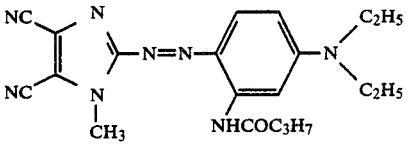 |
| 2-19 | 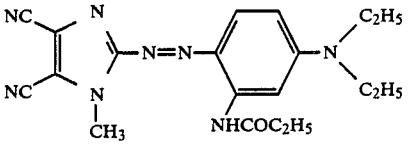 |
TABLE 2-continued
Magenta dyes represented by the formula (II)
| No. | Structural formula of dye |
|---|---|
| 2-20 | 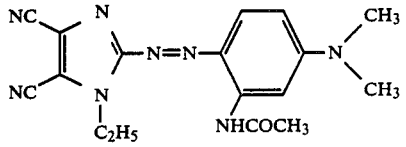 |
| 2-21 | 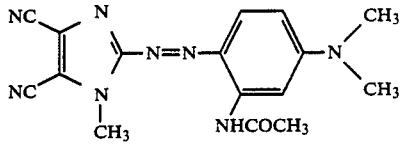 |
| 2-22 | 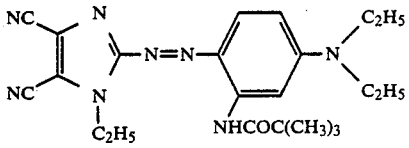 |
| 2-23 | 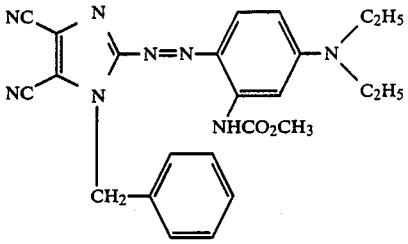 |
| 2-24 | 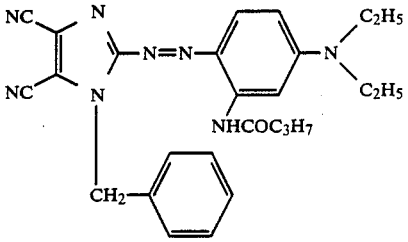 |
| 2-25 | 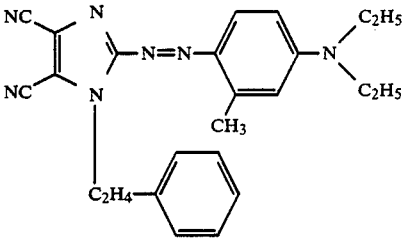 |
| 2-26 | 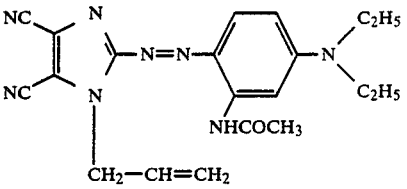 |

TABLE 2-continued
Magenta dyes represented by the formula (II)
| No. | Structural formula of dye |
|---|---|
| 2-27 | 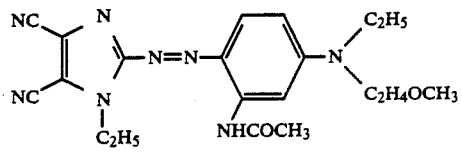 |
| 2-28 | 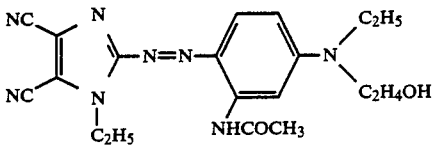 |
| 2-29 | 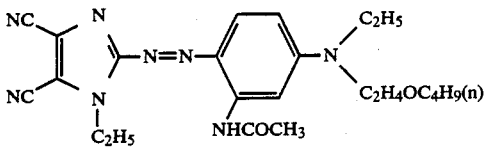 |
| 2-30 | 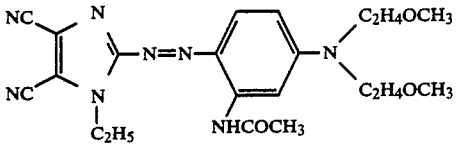 |
| 2-31 | 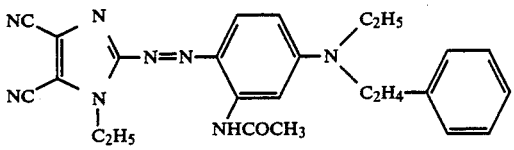 |
| 2-32 | 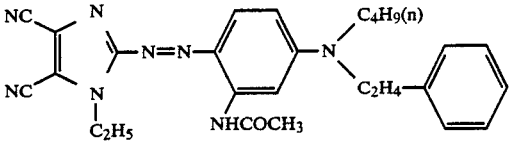 |
| 2-33 | 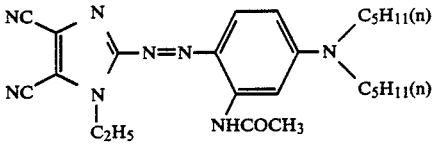 |
| 2-34 | 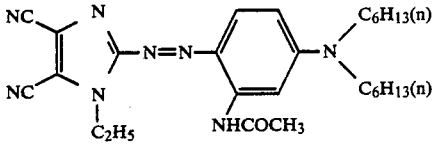 |
| 2-35 | 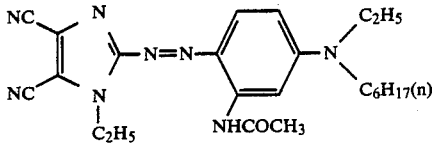 |
TABLE 2-continued
Magenta dyes represented by the formula (II)
| No. | Structural formula of dye |
|---|---|
| 2-36 | 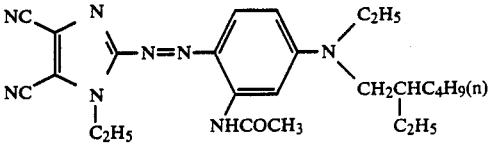 |
| 2-37 | 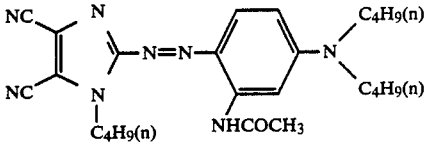 |
| 2-38 | 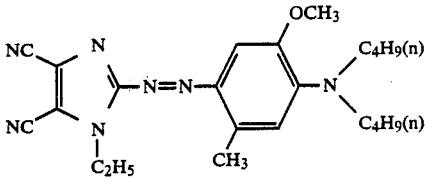 |
| 2-39 | 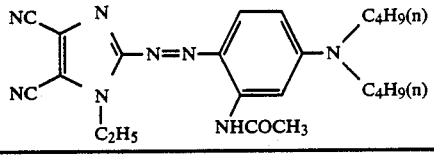 |
TABLE 3
Yellow dyes represented by the formula (III)
| No. | Structural formula of dye |
|---|---|
| 3-1 | 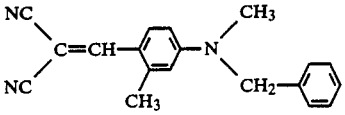 |
| 3-2 | 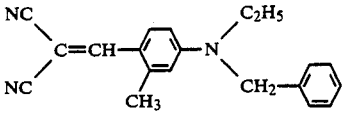 |
| 3-3 | 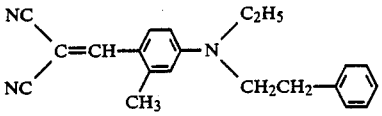 |
| 3-4 | 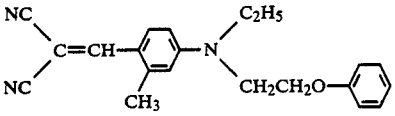 |
| 3-5 | 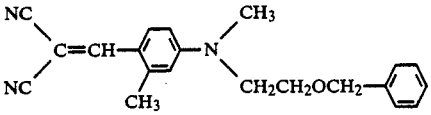 |
| 3-6 | 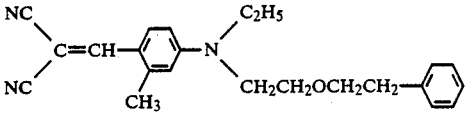 |

TABLE 3-continued
| No. | Yellow dyes represented by the formula (III) Structural formula of dye |
|---|---|
| 3-7 | 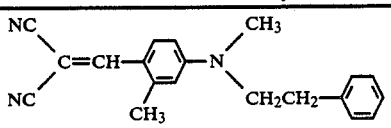 |
| 3-8 | 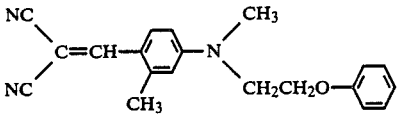 |
| 3-9 | 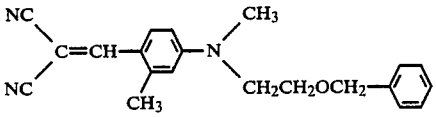 |
| 3-10 | 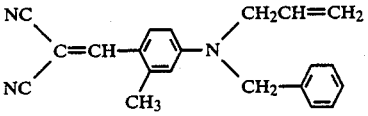 |
TABLE 3-continued
| No. | Yellow dyes represented by the formula (III) Structural formula of dye |
|---|---|
| 3-11 | 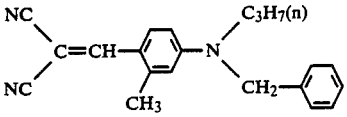 |
| 3-12 | 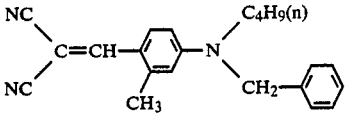 |
| 3-13 | 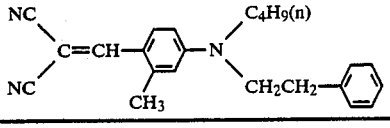 |
TABLE 4
| No. | Yellow dyes represented by the formula (IV) Structural formula of dye |
|---|---|
| 4-1 | 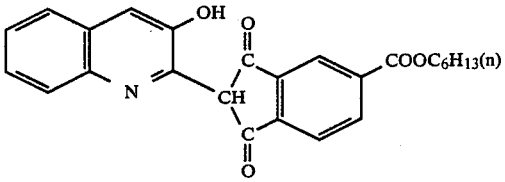 |
| 4-2 | 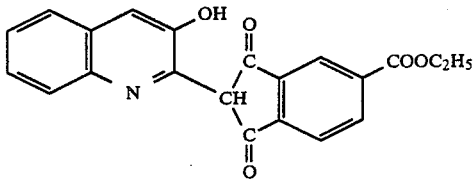 |
| 4-3 | 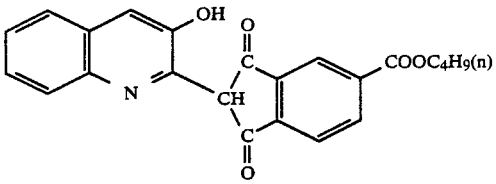 |
| 4-4 | 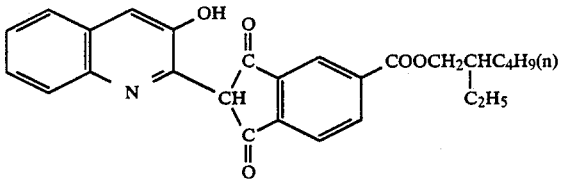 |
| 4-5 | 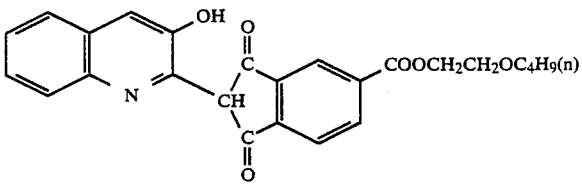 |

TABLE 4-continued
| Yellow dyes represented by the formula (IV) | |
|---|---|
| No. | Structural formula of dye |
| 4-6 | 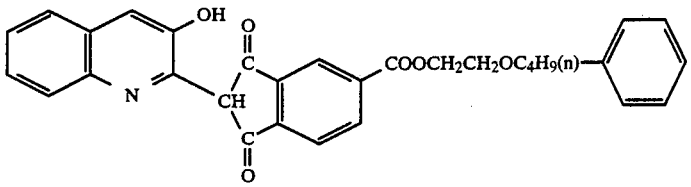 |
| 4-7 | 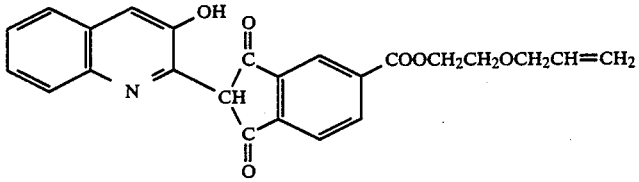 |
| 4-8 | 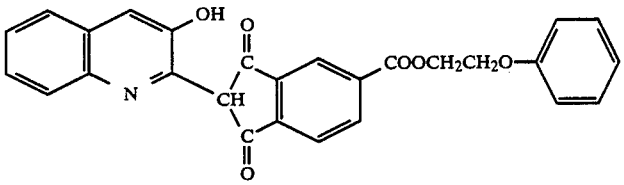 |
| 4-9 | 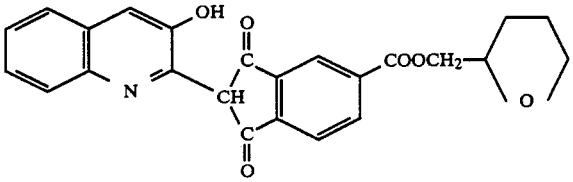 |
| 4-10 | 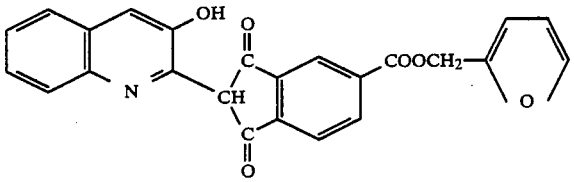 |
| 4-11 | 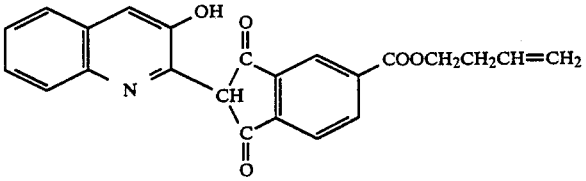 |
| 4-12 | 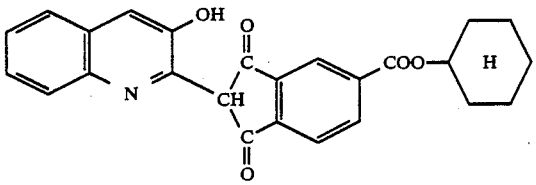 |

TABLE 4-continued
| No. | Yellow dyes represented by the formula (IV) Structural formula of dye |
|---|---|
| 4-13 | 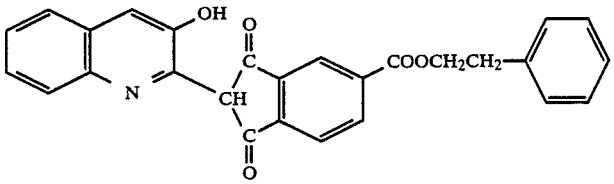 |
| 4-14 | 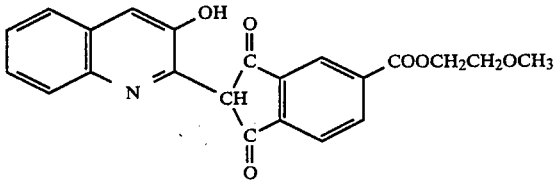 |
| 4-15 | 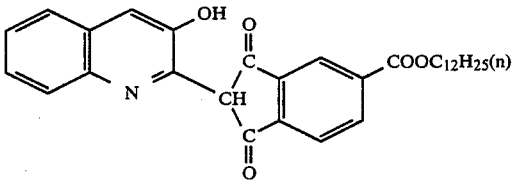 |
| 4-16 | 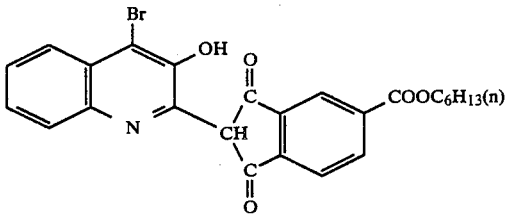 |
| 4-17 | 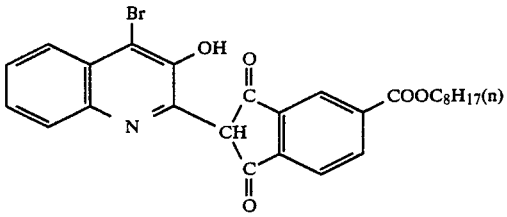 |
| 4-18 | 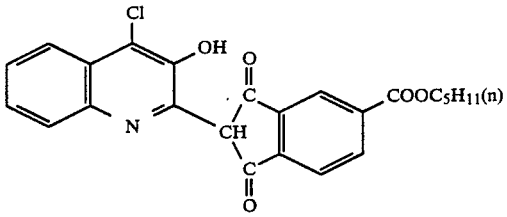 |
| 4-19 | 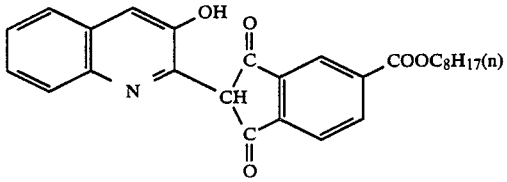 |

TABLE 5
Yellow dyes represented by the formula (V)
| No. | Structural formula of dye |
|---|---|
| 5-1 | 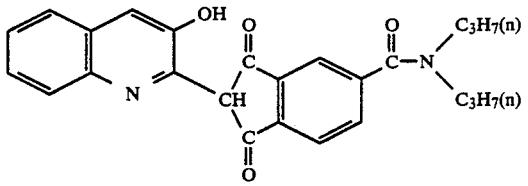 |
| 5-2 | 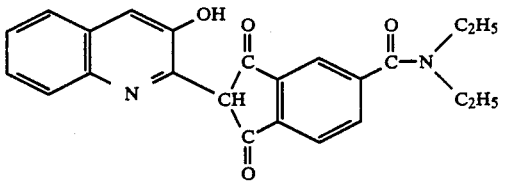 |
| 5-3 | 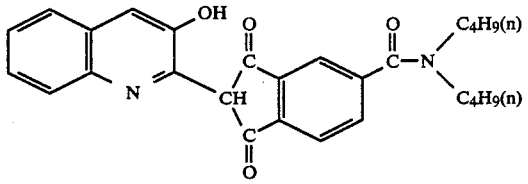 |
| 5-4 | 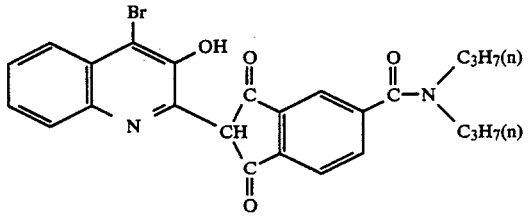 |
| 5-5 | 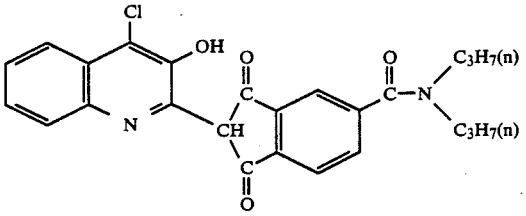 |
| 5-6 | 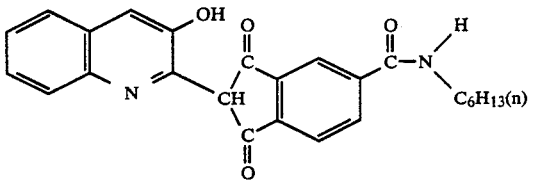 |
| 5-7 | 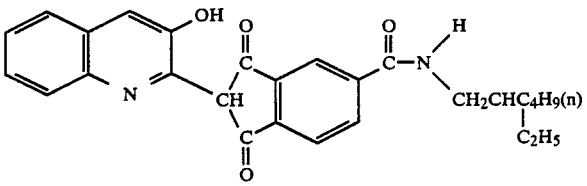 |

TABLE 5-continued
| No. | Yellow dyes represented by the formula (V) Structural formula of dye |
|---|---|
| 5-8 | 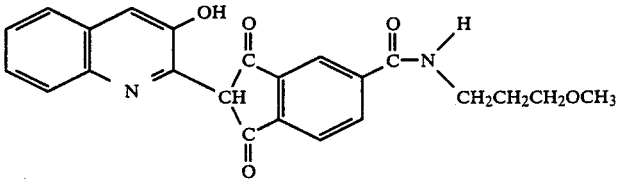 |
| 5-9 | 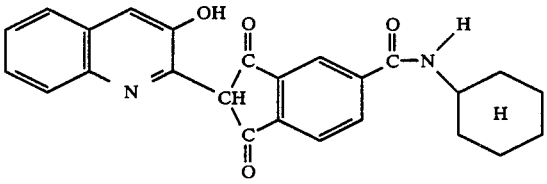 |
| 5-10 | 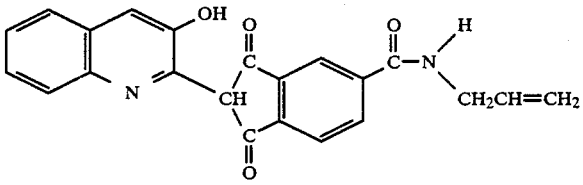 |
| 5-11 | 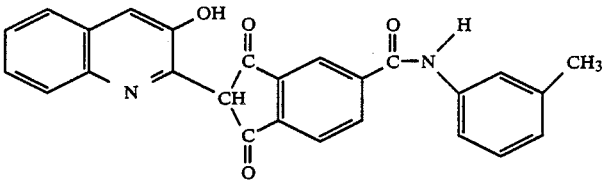 |
| 5-12 | 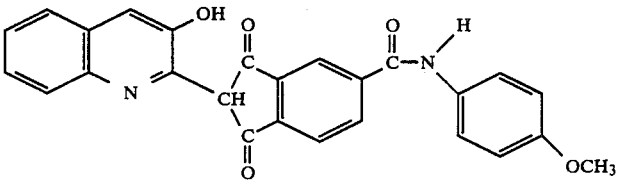 |
| 5-13 | 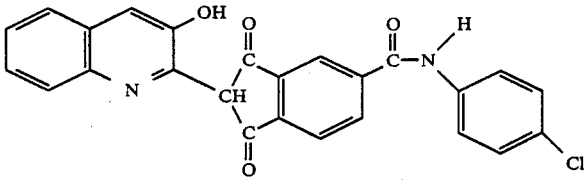 |
| 5-14 | 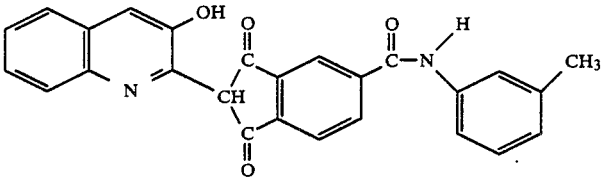 |
| 5-15 | 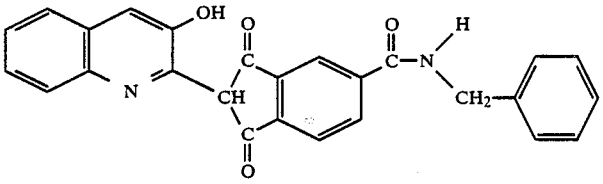 |

TABLE 5-continued
| No. | Yellow dyes represented by the formula (V) Structural formula of dye |
|---|---|
| 5-16 | 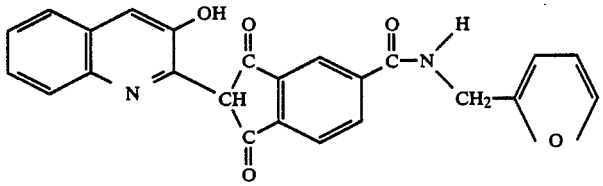 |
| 5-17 | 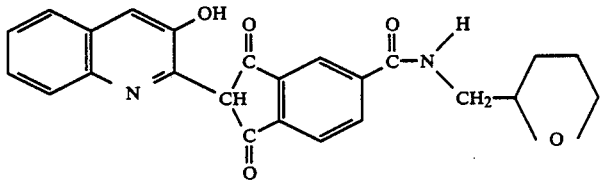 |
| 5-18 | 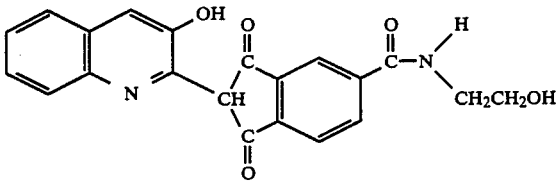 |
| 5-19 | 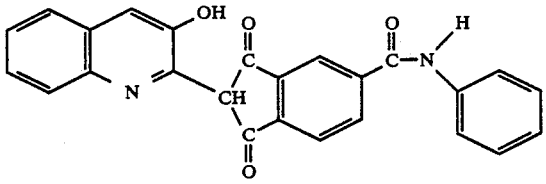 |
| 5-20 | 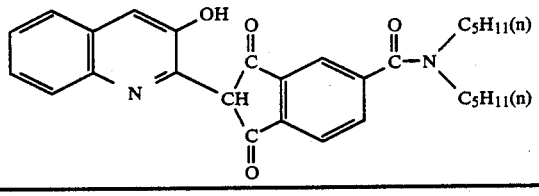 |
TABLE 6
| No. | Yellow dyes represented by the formula (VI) Structural formula of dye |
|---|---|
| 6-1 | 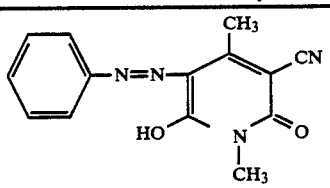 |
| 6-2 | 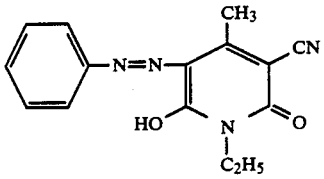 |
TABLE 6-continued
| No. | Yellow dyes represented by the formula (VI) Structural formula of dye |
|---|---|
| 6-3 | 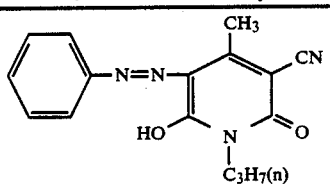 |
| 6-4 | 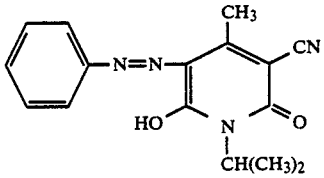 |

TABLE 6-continued
Yellow dyes represented by the formula (VI)
| No. | Structural formula of dye |
|---|---|
| 6-5 | 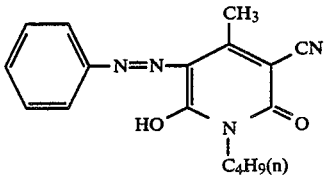 |
| 6-6 | 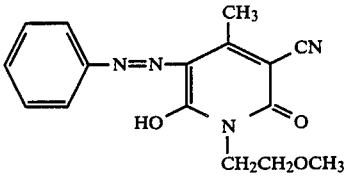 |
| 6-7 | 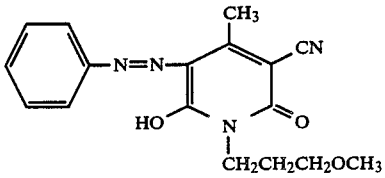 |
| 6-8 | 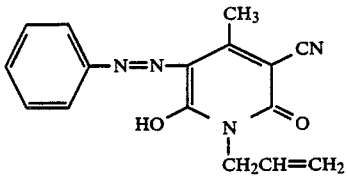 |
| 6-9 | 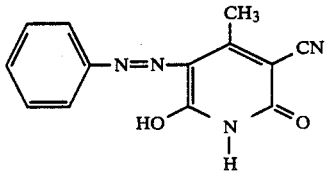 |
| 6-10 | 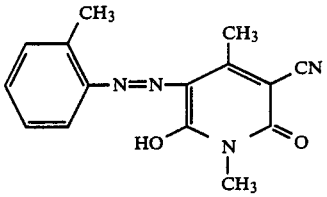 |
| 6-11 | 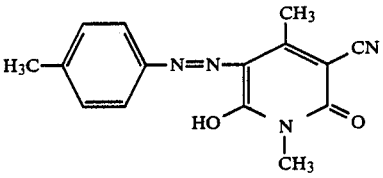 |
| 6-12 | 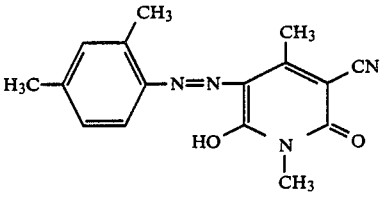 |
TABLE 6-continued
Yellow dyes represented by the formula (VI)
| No. | Structural formula of dye |
|---|---|
| 6-13 | 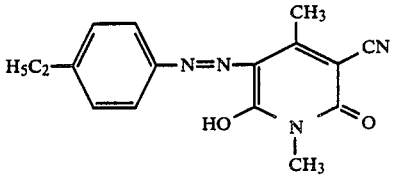 |
| 6-14 | 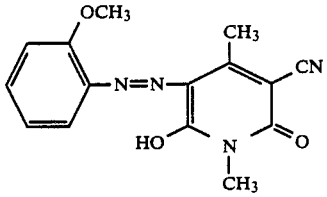 |
| 6-15 | 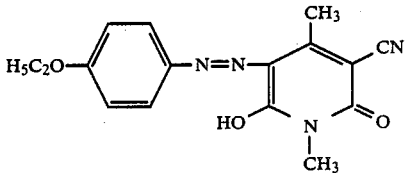 |
| 6-16 | 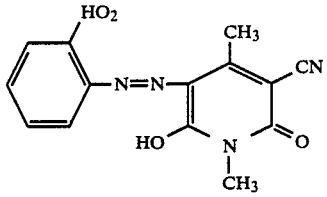 |
| 6-17 | 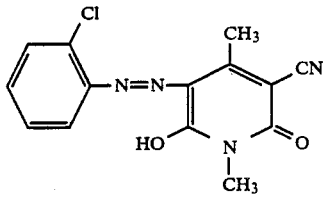 |
| 6-18 | 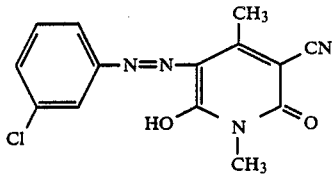 |
| 6-19 | 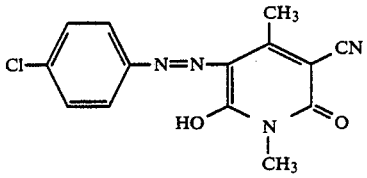 |
| 6-20 | 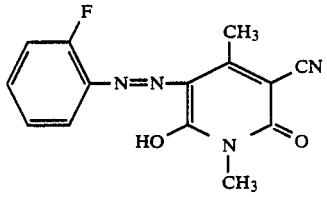 |

TABLE 6-continued
Yellow dyes represented by the formula (VI)
| No. | Structural formula of dye |
|---|---|
| 6-21 | 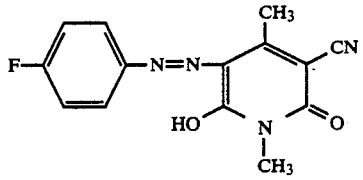 |
| 6-22 | 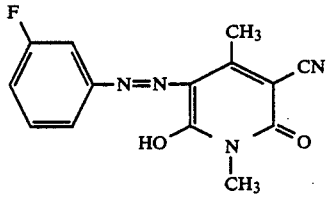 |
| 6-23 | 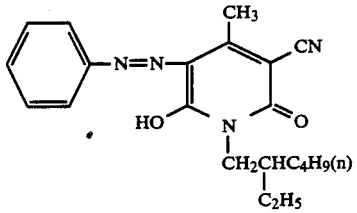 |
| 6-24 | 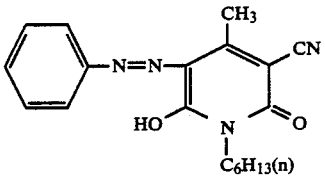 |
| 6-25 | 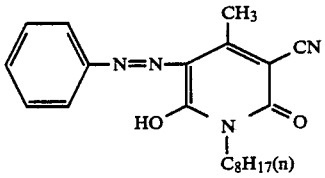 |
| 6-26 | 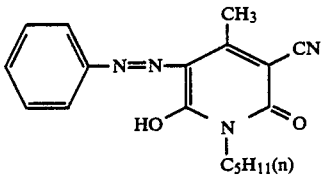 |
| 6-27 | 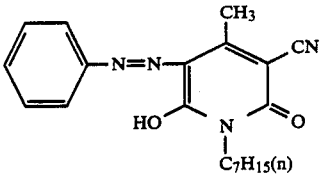 |
| 6-28 | 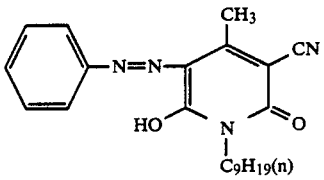 |
TABLE 6-continued
Yellow dyes represented by the formula (VI)
| No. | Structural formula of dye |
|---|---|
| 6-29 | 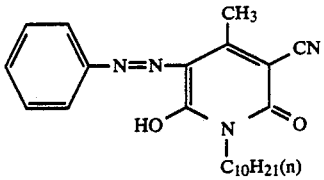 |
| 6-30 | 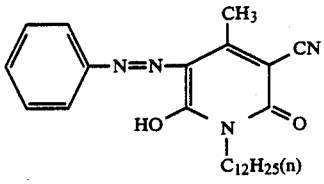 |
| 6-31 | 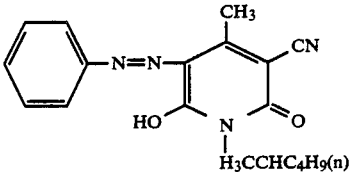 |
| 6-32 | 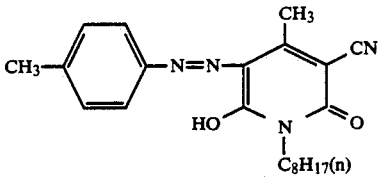 |
| 6-33 | 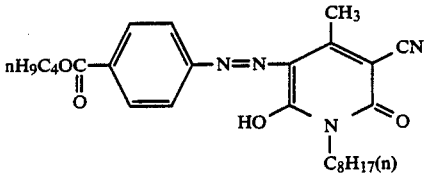 |
| 6-34 | 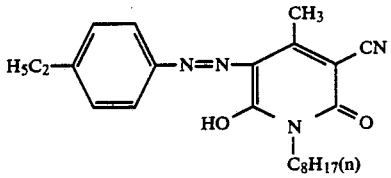 |
| 6-35 | 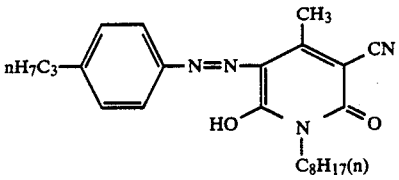 |
| 6-36 | 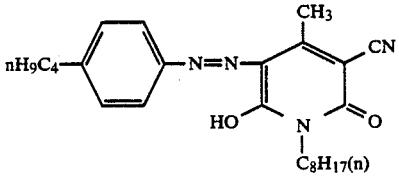 |

TABLE 6-continued

| No. | Yellow dyes represented by the formula (VI) Structural formula of dye |
|---|---|
| 6-37 | 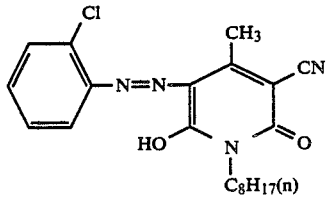 |
| 6-38 | 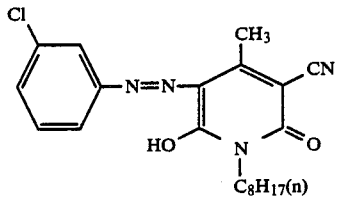 |
| 6-39 | 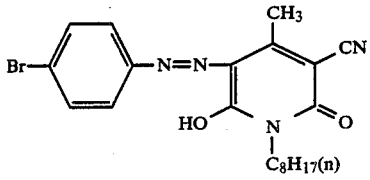 |
| 6-40 | 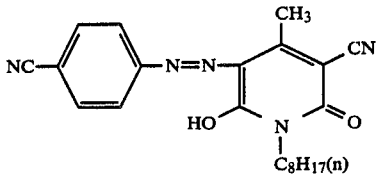 |
| 6-41 | 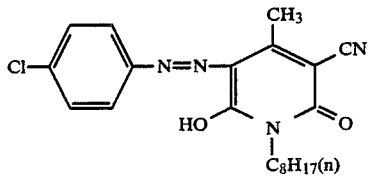 |
| 6-42 | 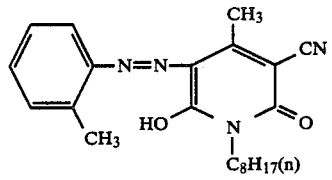 |
| 6-43 | 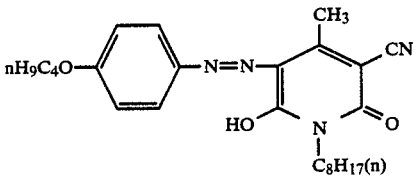 |
| 6-44 | 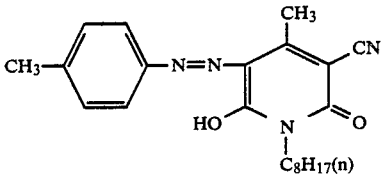 |
| 6-45 | 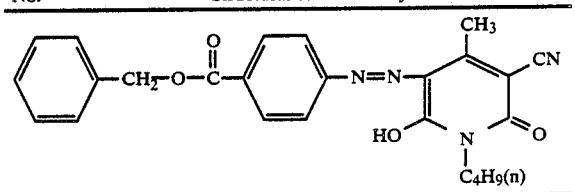 |

The dyes exemplified in the above tables can be all favorably used if they are used in combination of satisfying the conditions specified for the dyes used in the dye transfer type thermal printing sheets of the present invention, but it is preferred to use at least one dye of the formula (I) wherein $R^1$ represents a hydrogen atom or a methyl group; $R^2$ represents a hydrogen atom; $R^3$ represents a hydrogen atom or a halogen atom; $R^4$ represents a hydrogen atom or a methyl group; $R^5$ and $R^6$ each represents an alkyl group 1–4 carbon atoms; and R represents an alkyl group of 1–4 carbon atoms, at least one dye of the formula (II) wherein R represents an allyl group or an alkyl group of 1–4 carbon atoms; $R^1$ and $R^2$ each represents an alkyl group of 1–4 carbon atoms; and $R^3$ represents a methyl group or an acetylamino group and at least one dye represented by the formulas (III)–(VI). Among the dyes represented by the formulas (IV)–(VI), most preferred are those which are selected from the following dyes.

Dyes of the formula (IV) wherein X represents a hydrogen atom and R represents an alkyl group of 1–12 carbon atoms or an alkoxyalkyl group of 3–8 carbon atoms;

Dyes of the formula (V) wherein X represents a hydrogen atom or a bromine atom, $R^1$ and $R^2$ each represents an alkyl group of 1–12 carbon atoms or an alkoxyalkyl group of 3–8 carbon atoms;

Dyes of the formula (VI) wherein

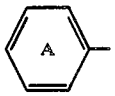

represents a phenyl group which may be substituted with an alkyl group of 1–4 carbon atoms, an alkoxy group of 1–4 carbon atoms, a halogen atom, nitro group, cyano group, an alkoxycarbonyl group of 2–5 carbon atoms or benzyloxycarbonyl group and R represents an alkyl group of 1–12 carbon atoms, an alkoxyalkyl group of 2–5 carbon atoms or an allyl group.

Resins used as a binder have no special limitation and include, for example, water-soluble resins of cellulose type, acrylic acid type and starch type and resins soluble in organic solvents or water such as acrylic resin, polyphenylene oxide, polysulfone, polyether sulfone, ethyl cellulose and acetyl cellulose. Considering recording sensitivity and storage stability of the sheet, those which have a heat distortion temperature (ASTM D648) of 70°–150° C. are excellent. Therefore, preferred are polystyrene, polyvinyl butyral, polycarbonate, methacrylate resin, acrylonitrile.styrene copolymer, polyester resin, urethane resin, chlorinated polyethylene and chlorinated polypropylene. Further, coloring material layer 2 may contain dispersing agent for dyes or plastisizer, lubricants for promoting separation from image receiving material after recording, surfactant particles and the like.

As solvents used for preparation of ink which constitutes the coloring material layer containing the dyes and binder, there may be used alcohols such as methanol, ethanol, propanol and butanol, cellosolves such as methyl cellosolve and ethyl cellosolve, aromatic compounds such as benzene, toluene and xylene, esters such as butyl acetate, ketones such as acetone, 2-butanone and cyclohexanone, nitrogen compounds such as N,N-dimethylformamide and halogenated hydrocarbons such as dichloromethane, chlorobenzene and chloroform. When water-soluble or water-dispersible aqueous resin is used as a binder, water or a mixture of water with the above solvent may also be used.

Ink can be coated on a substrate by reverse-roll coating, gravure coater, rod coater, air doctor coater, etc.

Coating amount of the ink may be 0.1–5 g/m$^2$ after drying.

The following nonlimiting examples further explain the present invention.

EXAMPLE 1

A PET film of 6 μm thick provided with a heat resistant lubricating layer on under surface was used as a substrate. On the upper surface were coated inks obtained by dissolving 2 g of each of Dye Nos. 1–5, 2–37 and 5–4 enumerated in Tables 1, 2 and 5 and 4 g of polycarbonate (Teijin Panlite L1250 supplied by Teijin Kasei Co.) in 25 g of dichloromethane by a wire bar in the sequence of magenta (No. 2–37), yellow (No. 5–4) and cyan (No. 1–5), followed by drying by hot air to obtain a transfer sheet having three faces.

Then, an image receiving sheet was prepared by coating a coating composition composed of 20 g of an aqueous polyester resin (Bilonal MD1200 supplied by Toyobo Co., Ltd.) and 40 g of colloidal silica (Snowtex 40 supplied by Nissan Chemical Co. Ltd.) on a upper surface of a PET white synthetic poper by a wire bar.

These transfer sheet and image receiving sheet were put together so that the coated surface were in close contact with each obtained and recording was effected by a thermal head. Recording conditions were as follows:

Line density for main scanning and subsidiary scanning: 4 dots/mm

Recording electrical power: 0.7 W/dot

Heating time of head: 8 msec

Figure 2:
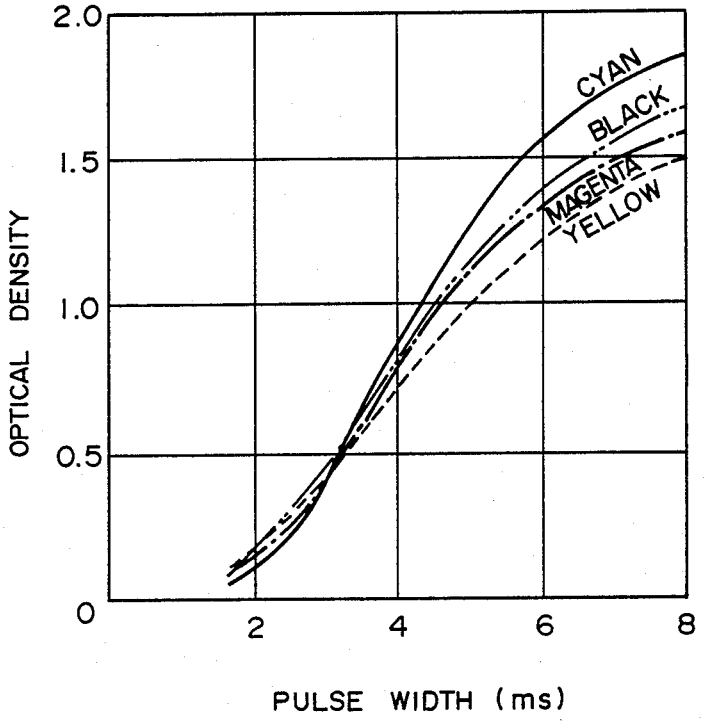
FIG. 2 is a graph which shows record density characteristics of the dye transfer type thermal printing sheet in example of the present invention.
Figure 3:
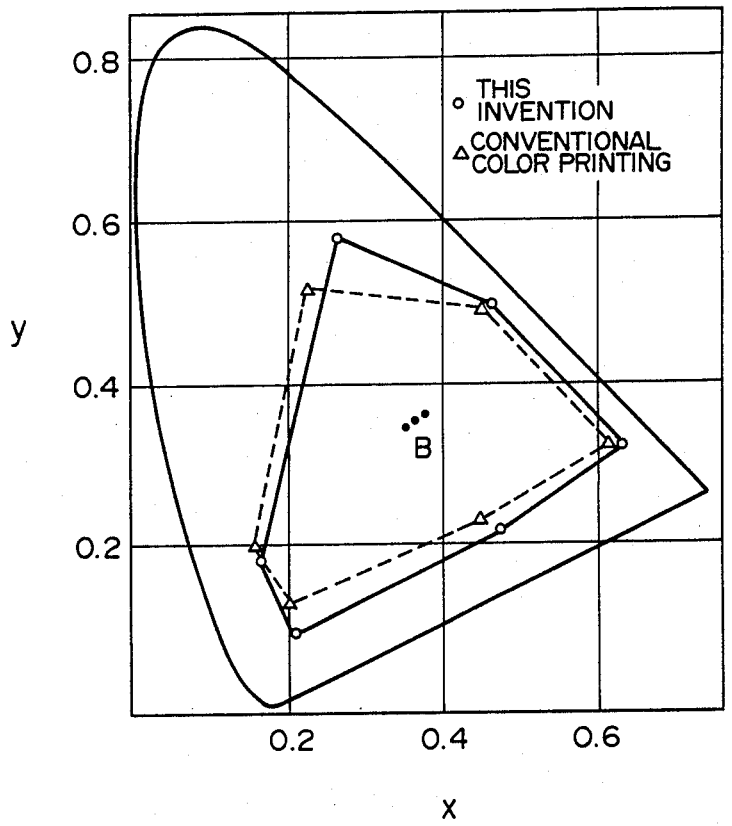
FIG. 3 is a chromaticity diagram of record images in example of the present invention.

In this case, reflective recording densities of magenta, yellow and cyan colors were 1.6, 1.5 and 1.8, respectively. Density characteristics when heating time of head was changed in the range of 0–8 msec are shown in FIG. 2. When image was recorded on one image receiving sheet by overlapping magenta, yellow and cyan inks in this sequence using the above transfer sheet of three faces of magenta, yellow and cyan. As a result, density characteristics of black as also shown in FIG. 2 were obtained. The densities of black were plotted on the chromaticity diagram as shown in FIG. 3 to find that all were concentrated around the point indicated by B. When magenta, yellow and cyan colors were optically overlaid to produce mixed colors, chromaticity points as also shown in FIG. 3 were obtained. This was considerably close to color printing.

EXAMPLE 2

In the same manner as in Example 1, each dye of 1 g of No. 1–5 and 1 g of No. 1–46 for cyan dye, 2 g of No. 2–37 for magenta dye and 0.6 g of No. 4–19 and 1.2 g of No. 5–4 for yellow dyes was dissolved in 25 g of dichloromethane together with 4 g of polycarbonate and a transfer sheet comprising three faces of yellow, magenta and cyan in this sequence was prepared in the same manner as in Example 2 using these inks. Recording of images was carried out in the same manner as in Example 1 except that the sequence of recording was changed to yellow, magenta and cyan to obtain favorable results similar to those of Example 1.

EXAMPLE 3

In the same manner as in Example 1, each dye of 1 g of No. 1–5 and 1 g of No. 1–46 for cyan, 2 g of No. 2–26 for magenta and 2 g of No. 6–37 for yellow was dissolved in 25 g of dichloromethane together with 4 g of polycarbonate and a transfer sheet comprising three faces of yellow, magenta and cyan in this sequence was prepared using these inks in the same manner as in Example 1. Recording of images was carried out in the same manner as in Example 1 except that the sequence of recording was changed to yellow, magenta and cyan to obtain favorable results similar to those of Example 1.

EXAMPLE 4

0.5 Grams of No. 1–6 and 0.5 of No. 1–40 as dyes of cyan color, 0.5 g of No. 2–1 and 0.5 g of No. 2–3 as dyes of magenta color and 0.3 g of No. 3–12, 0.3 g of No. 4–19 and 0.3 g of No. 5–4 as dyes of yellow color were dissolved in 25 g of dichloromethane together with 4 g of polysulfone (P-1700 supplied by Nissan Chemical Industries, Ltd.) to produce a black ink. A transfer sheet was prepared using this black ink. When recording of images was effected in the same manner as in Example 1, the density was concentrated around point B on chromaticity diagram as in the case of recording effected by overlaying the three colors in Example 1.

The record images obtained in Examples 1–4 were tested on light-fastness in accordance with JIS LO841 to obtain ratings of 4–5 and it was found that they were sufficiently fit for practical use. Furthermore, discoloration of the record images in dark was evaluated by leaving them in atmosphere of 60° C., 70° C. and 80° C. (relative humidity: 60% for all of them). No change of color was recognized in the case of 60° C., 60% RH, 300 hours. Furthermore, life before density decreases by 10% was estimated ay Aurenius' plotting method to obtain several ten years.

With reference to storage stability of transfer sheet per se, it was found that change of record density was less than 10% even after left for 2 years at room temperature.

What is claimed is:

1. A dye transfer type thermal printing sheet wherein the coloring material layers contain either of at least one dye represented by the formula (I)

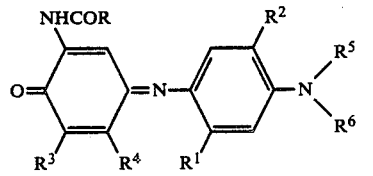

(I)

wherein $R^1$ represents a hydrogen atom or a methyl group, $R^2$ represents a hydrogen atom, $R^3$ represents a hydrogen atom or a halogen atom, $R^4$ represents a hydrogen atom or a methyl group and $R^5$ and $R^6$ each represents an alkyl group of 1–4 carbon atoms, at least one dye represented by the formula (II)

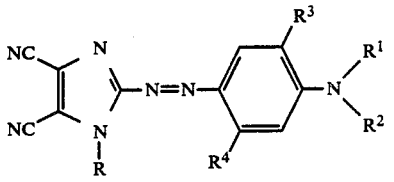

(II)

wherein R represents an allyl group or an alkyl group of 1–4 carbon atoms, $R^1$ and $R^2$ each represents an alkyl group of 1–4 carbon atoms, $R^3$ represents a hydrogen atom and $R^4$ represents a methyl group or an acetylamino group, and at least one dye represented by the formula (IV)

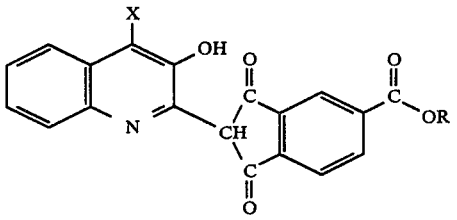

(IV)

wherein X represents a hydrogen atom and R represents an alkyl group of 1–12 carbon atoms or an alkoxyalkyl group of 3–8 carbon atoms.

2. A dye transfer type thermal printing sheet wherein the coloring material layers contain either of at least one dye represented by the formula (I)

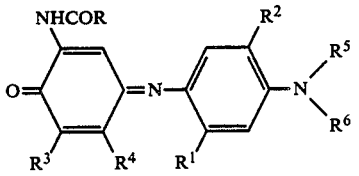

(I)

wherein $R^1$ represents a hydrogen atom or a methyl group, $R^2$ represents a hydrogen atom, $R^3$ represents a hydrogen atom or a halogen atom, $R^4$ represents a hydrogen atom or a methyl group, and $R^5$, $R^6$, and R each represents an alkyl group of 1–4 carbon atoms, at least one dye represented by the formula (I)

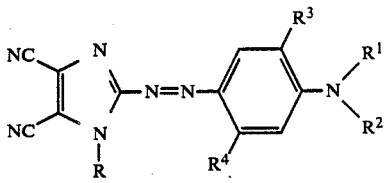

(II)

wherein R represents an allyl group or an alkyl of 1–4 carbon atoms, $R^1$ and $R^2$ each represents an alkyl group of 1–4 carbon atoms, $R^3$ represents a hydrogen atom and $R^4$ represents a methyl group or an acetylamino group, and at least one dye represented by the formula (V)

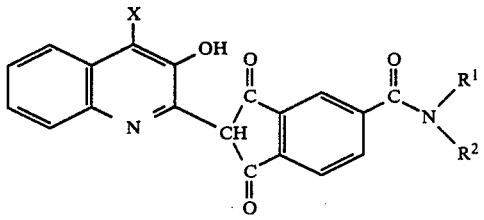

(V)

wherein X represents a hydrogen atom or a bromine atom and $R^1$ and $R^2$ each represents an alkyl group of 1–12 carbon atoms or an alkoxyalky group of 3–8 carbon atoms.

* * * * *

UNITED STATES PATENT AND TRADEMARK OFFICE

CERTIFICATE OF CORRECTION

PATENT NO. : 4,985,396

DATED : January 15, 1991

INVENTOR(S) : KAWAKAMI et al

It is certified that error appears in the above-identified patent and that said Letters Patent is hereby corrected as shown below:

The structure Column 8, lines 20-26

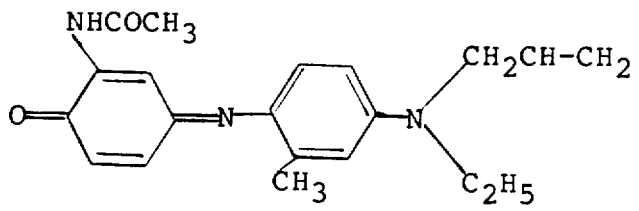

Should read

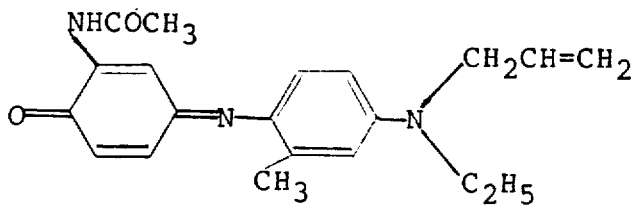

UNITED STATES PATENT AND TRADEMARK OFFICE

CERTIFICATE OF CORRECTION

PATENT NO. : 4,985,396

DATED : January 15, 1991

INVENTOR(S) : KAWAKAMI et al

It is certified that error appears in the above-identified patent and that said Letters Patent is hereby corrected as shown below:

The structure Column 8, lines 46-53

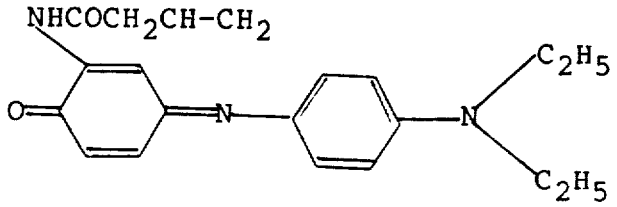

Should read

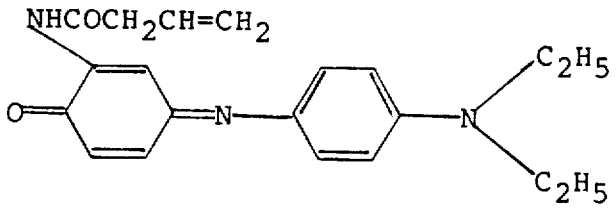

UNITED STATES PATENT AND TRADEMARK OFFICE

CERTIFICATE OF CORRECTION

PATENT NO. : 4,985,396

DATED : January 15, 1991

INVENTOR(S) : KAWAKAMI et al

It is certified that error appears in the above-identified patent and that said Letters Patent is hereby corrected as shown below:

The structure Column 12, lines 13-18

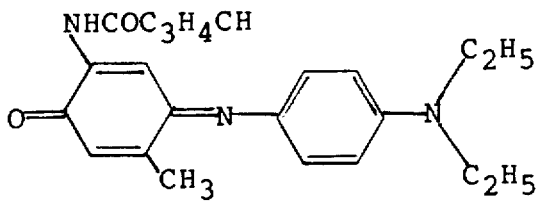

Should read

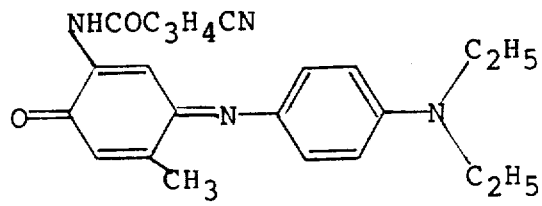

UNITED STATES PATENT AND TRADEMARK OFFICE

CERTIFICATE OF CORRECTION

PATENT NO. : 4,985,396

DATED : January 15, 1991

INVENTOR(S) : KAWAKAMI et al

It is certified that error appears in the above-identified patent and that said Letters Patent is hereby corrected as shown below:

The structure Column 34, lines 21-27

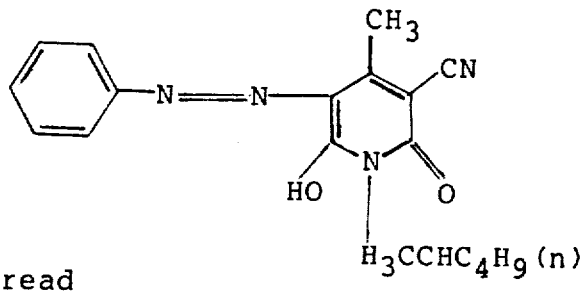

Should read

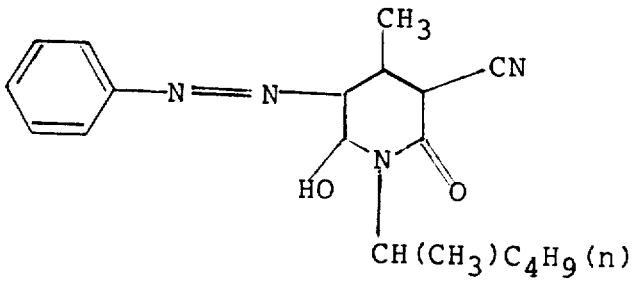

Signed and Sealed this

Fifth Day of October, 1993

*Attest:*

*Attesting Officer*

BRUCE LEHMAN

*Commissioner of Patents and Trademarks*